United States Patent [19]

Coburn et al.

[11] 4,226,896

[45] Oct. 7, 1980

[54] PLASMA METHOD FOR FORMING A METAL CONTAINING POLYMER

[75] Inventors: John W. Coburn; Eric Kay, both of San Jose, Calif.

[73] Assignee: International Business Machines Corporation, Armonk, N.Y.

[21] Appl. No.: 863,826

[22] Filed: Dec. 23, 1977

[51] Int. Cl.[2] ..... B05D 1/10; C23C 13/02

[52] U.S. Cl. ..... 427/34; 156/643; 427/39; 427/253; 428/422

[58] Field of Search ..... 427/34, 39, 40, 4 L, 427/253; 204/192 E, 192 EC, 192 C; 156/643; 428/422

[56] References Cited

U.S. PATENT DOCUMENTS

| | | | |
|---|---|---|---|
| 3,732,158 | 5/1973 | Przybyszewski et al. | 204/192 N |
| 3,867,216 | 2/1975 | Jacob | 204/192 E X |
| 3,912,461 | 10/1975 | Wakefield | 204/192 C X |
| 3,971,684 | 7/1976 | Muto | 204/192 E X |
| 3,984,301 | 10/1976 | Matsuzaki et al. | 204/192 R |
| 4,013,532 | 3/1977 | Cormia et al. | 204/192 C |
| 4,026,742 | 5/1977 | Fujino | 156/643 |
| 4,091,166 | 5/1978 | Kubacki | 427/41 X |

FOREIGN PATENT DOCUMENTS

| | | | |
|---|---|---|---|
| 1417085 | 12/1975 | United Kingdom | 156/643 |

*Primary Examiner*—John D. Smith
*Assistant Examiner*—Thurman K. Page
*Attorney, Agent, or Firm*—Joseph E. Kieninger

[57] ABSTRACT

A plasma process for forming a polymer film containing metal therein includes the steps of providing an electrode of a metal that can be etched by a halogen, providing a substrate for the polymer film to be deposited thereon, and passing a halocarbon monomer through a plasma system so that the metal etched from the electrode forms a volatile halide and is incorporated in the polymer film that is deposited on the substrate.

8 Claims, 1 Drawing Figure

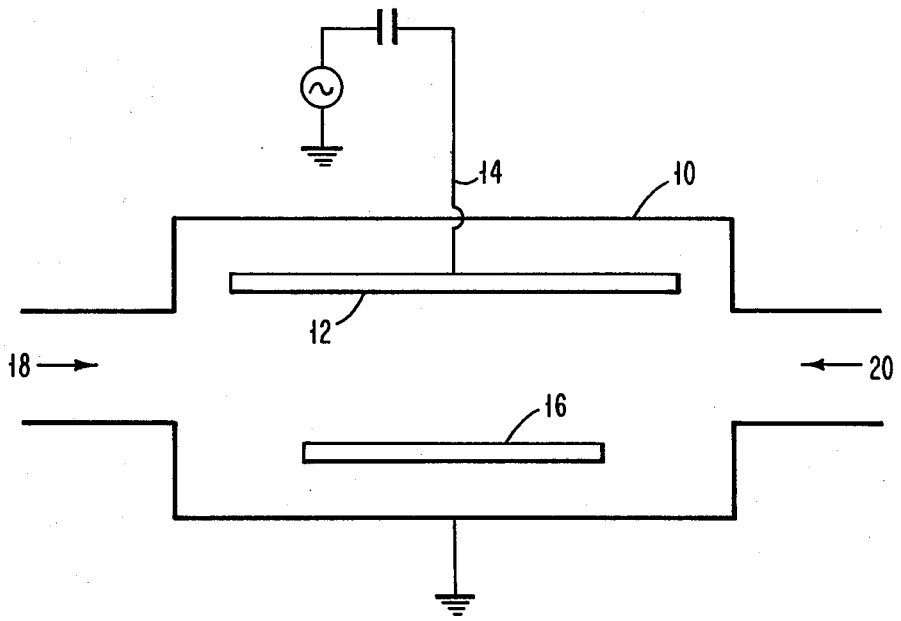
14
10
12
18
20
16

PLASMA METHOD FOR FORMING A METAL CONTAINING POLYMER

FIELD OF THE INVENTION

This invention relates to the plasma deposition of polymers and more particularly to the plasma deposition of a polymer containing a metal therein by establishing conditions where etching and polymerization occur simultaneously in the same system.

PRIOR ART

It is well known that in a plasma system, polymerization can occur on all surfaces when an unsaturated monomer is passed through a system containing a glow discharge. The glow discharge can be formed by an electrode within the system or by a coil surrounding the outside of the system.

Plasma polymerized materials have a unique chemical structure and their properties are substantially different from polymers made by conventional polymerization methods starting with identical monomers. In general, plasma polymerized materials are very insoluble, and have highly cross-linked three dimensional networks. Plasma polymerized polymers synthesized from halocarbon monomers, particularly fluorocarbon monomers, tend to be particularly stable chemically. They are more stable than their conventionally polymerized counterparts.

It is to be expected that the electrical, optical, thermal, mechanical and chemical properties including the radiation sensitivity of polymers will be influenced by metal incorporation and this has been found to be true in those few instances where metal containing polymers have been synthesized by other methods (for example, simultaneous evaporation of metal and polymer.)

SUMMARY OF THE INVENTION

It is an object of this invention to provide an improved polymer.

It is another object of this invention to provide an improved plasma polymerized polymer.

It is still another object of this invention to provide a method for forming a plasma polymerized polymer containing metal therein.

These and other objects are accomplished by a plasma polymerization process which includes the step of placing an electrode within the plasma system in which the electrode is etched by the halocarbon. A suitable halocarbon is then passed through the system to etch the electrode and to polymerize a polymer film on a substrate. The metal that is etched from the electrode forms a volatile halide and is incorporated into the polymer that is deposited upon the substrate. In a preferred embodiment, the electrode is molybdenum and the monomer is $C_3F_8$.

Other objects, of this invention will be apparent from the following detailed description. Reference being made to the accompanying drawing wherein a preferred embodiment of this invention is shown.

IN THE DRAWING

The FIGURE is a schematic view of the apparatus employed in the method of this invention.

DESCRIPTION OF THE ILLUSTRATED EMBODIMENTS

The method of this invention may be practiced in an apparatus of the type shown in the FIGURE, although it is not limited thereto. The vacuum system 10 contains an electrode 12 positioned therein. A power source is connected by line 14 to electrode 12. A substrate 16 is positioned so that it is preferably coplanar or cospherical with the electrode 12. Monomer gasses from a source not shown are injected through opening 18 at a controlled rate. The effluent gasses are removed through opening 20 which is connected to a suitable vacuum pump (not shown).

In accordance with this invention, the electrode 12 is of a metal which can be etched by a halogen to form a volatile halide. Molybdenum is a preferred metal to be used with a monomer gas containing fluorine since it forms the volatile halide, $MoF_6$, that is incorporated into the polymer film that is deposited on the substrate. Other non-limiting examples of metals which form the following volatile fluorides are $WF_6$, $BF_3$, $UF_6$, and $IrF_6$. Non-limiting examples of metals which form the following volatile chlorides are $TiCl_4$, $GaCl_3$, $VCl_4$, $Al_2Cl_6$ and $SnCl_4$. Non-limiting examples of metals which form the following volatile halides are $AsBr_3$, $GeBr_4$, $SiBr_4$, $PBr_3$ and $AlBr_3$. Non-limiting examples of metals which form the following volatile iodides are $GeI_4$, $AuI_4$, $MoI_4$ and $SiI_4$. Other metals may be used which would form either a volatile fluoride, chloride, bromide or iodide. It is necessary that the metal in the volatile metal halide can be chemically incorporated into the polymer film. Some volatile metal halides are not chemically incorporated into the polymer film.

It is to be pointed out that although conventional plasma polymerization systems may employ either an electrode within the system as shown in the FIGURE or a coil surrounding the outside of the system, this invention requires that the electrode be within the system so that the metal can be etched by the gas to form a volatile halide. The excitation power that is capacitively applied through line 14 to electrode 12 is, for example, 50 to 150 watts, that is, between $\frac{1}{2}$ and $1\frac{1}{2}$ watts per square centimeter. The frequency of the applied voltage is of the order of 13.56 MHz. Direct current may also be used. Both the power and the frequency can be varied over broad ranges as is well known to those skilled in the art.

The structure shown in the FIGURE is only one example of numerous possible configurations. Another configuration may include more than one electrode to sustain the discharge.

Halocarbon monomers which polymerize in the plasma polymerization system are used as long as they will etch the metal in the electrode 12 and form a volatile halide. Fluoro compounds or mixtures of fluoro compounds are preferred monomers as long as the overall fluorine/carbon (F/C) ratio is such that etching occurs on electrode 12 while polymerization occurs on substrate 16. It is necessary that the F/C ratio of the monomer gases be greater than 2 to accomplish etching of electrode 12. For example, $C_4F_{10}$ and $C_3F_8$ provide satisfactory results under normal operating conditions. The preferred F/C ratio is 2.1 to 2.9. Monomer gases with F/C ratios $\geq 3$ ($CF_4$ and $C_2F_6$) provide satisfactory results if the F consumption caused by the etching of electrode 12 is significant compared to the monomer gas flow (i.e., low monomer gas flows are required. If the gas flow is large, etching will occur on substrate 16). The parameters of the plasma process, that is, the frequency of the applied voltage, the excitation power, the pressure and the gas flow rate can be adjusted or varied to control the rate at which etching occurs on electrode 12 and the rate at which polymerization occurs on substrate 16 thereby providing control over the concentration of the metal in the polymer film.

Halocarbon monomers containing chlorine, bromine or iodine may also be used as long as these gates etch the metal in electrode 12 to form a volatile metal halide and at the same time polymerize to form a stable polymer on the substrate 16.

EXAMPLE NO. 1

The gas $C_3F_8$ at a pressure of 20 millitorr at a flow rate of 3 $cm^3$/min was passed into the plasma polymerization chamber similar to that shown in the FIGURE. The power at a level of 50 watts and having a RF frequency of 13.56 MHz was applied to the electrodes. The molybdenum electrode which had an area of 100 $cm^2$ was etched and formed volatile $MoF_6$ as demonstrated by plasma mass spectroscopy. The polymer deposition rate on the substrate was 2.9 A°/sec. The deposition was continued with 1100 seconds to form a layer 3,190 A° thick. The film was analyzed and found to have 11 weight % molybdenum therein.

EXAMPLE NO. 2

The gas $C_3F_8$ was passed through the same plasma polymerization system at a flow rate of 20 $cm^3$/minute with a gas pressure of 20 millitorr. The power was 50 watts at a frequency of 13.56 MHz. The deposition rate was 4.1 A°/second and the run was continued for 5080 seconds to yield a polymer having a thickness of 20,830 A°. This film had 18 weight % molybdenum therein.

EXAMPLE NO. 3

The gas $C_3F_8$ had a pressure of 20 millitorr and was passed through the same plasma polymerization system with a gas flow rate of 50 $cm^3$/minute. A power of 150 watts was applied. The deposition rate was 14.6 A°/-second. The deposition was carried on for 2815 seconds to yield a polymer 41,100 A° thick. The polymer contained 28 weight % molybdenum.

EXAMPLE NO. 4

The gas $CF_4$ at a pressure of 20 millitorr was passed through the same type of plasma polymerization system at a gas flow rate of 1 $cm^3$/minute. The power was 50 watts at a frequency of 13.56 MHz. A polymer film was formed containing molybdenum. Normally, $CF_4$ produces etching on the substrate as well as the electrodes at normal gas flow rates. Under normal flow rates, no polymer is formed. In this example, a polymer was formed because the gas flow rate of 1 $cm^3$/minute was low. In this case, the etching of the molybdenum electrode consumed so much fluorine that the F/C ratio of the remaining gas molecules was decreased to the point where polymerization occurred on the substrate.

EXAMPLE NO. 5

The gas $C_2F_4$ having a F/C ratio of 2 and at a pressure of 20 millitorr was passed through the same plasma polymerization system at a gas flow rate of 5 $cm^3$/minute. The power of 50 watts at a frequency of 13.56 MHz was used. In this example, polymerization occurred on both the substrate and on the electrode as well. There was no etching on the electrode. As a result, there was no metal incorporated in the polymer that was formed. This result indicated that a F/C ratio of 2 was too low under these operating conditions. The major advantage of this invention as a thin film deposition method is its adaptability to the deposition of uniformly thick films with uniform chemical composition (both as a function of thickness and as a function of position on the surface) over large areas.

Although preferred embodiments of this invention have been described, it is understood that numerous variations may be made in accordance with the principles of this invention.

We claim:

1. A plasma process for forming a polymer film containing metal therein comprising the steps of:

providing a closed vacuum system having gas input means and gas exhaust means;

providing a first electrode in said system of a metal adapted to be plasma etched by a halogen to form a volatile halide;

providing a substrate in said system in spaced relation to said first electrode and adapted to have a polymer film deposited thereon;

passing a halocarbon monomer through said system, said monomer plasma etching said first electrode to form a volatile halide and forming at the same time a stable polymer on said substrate when a glow discharge is established by the application of a suitable voltage to said first electrode; and applying a suitable voltage to said first electrode whereby metal plasma etched from said first electrode is incorporated into the polymer film that is deposited on said substrate.

2. A method as described in claim 1 whereby the electrode is made of molybdenum.

3. A method as described in claim 1 whereby the halocarbon contains fluorine.

4. A method as described in claim 3 whereby the halocarbon is $C_3F_8$.

5. A method as described in claim 3 whereby the F/C ratio in the halocarbon is $>2$.

6. A method as described in claim 5 whereby the F/C ratio is 2.1 to 2.9.

7. A method as described in claim 5 whereby when the F/C ratio $\geq 3$ the fluorocarbon monomer flow rate is slowed to a level sufficient to result in polymerization occurring in addition to etching.

8. A method as described in claim 1 whereby a second electrode of a suitable voltage is used.

* * * * *